US009345346B1

(12) United States Patent
O'Flaherty et al.

(10) Patent No.: US 9,345,346 B1
(45) Date of Patent: May 24, 2016

(54) CORD STORAGE DEVICE

(71) Applicants: Paul O'Flaherty, Cornwall, NY (US); Margaret Fleck, Cornwall, NY (US)

(72) Inventors: Paul O'Flaherty, Cornwall, NY (US); Margaret Fleck, Cornwall, NY (US)

(73) Assignee: Infinite Limit, LLC, Cornwall, NY (US)

( * ) Notice: Subject to any disclaimer, the term of this patent is extended or adjusted under 35 U.S.C. 154(b) by 0 days.

(21) Appl. No.: 14/457,717

(22) Filed: Aug. 12, 2014

Related U.S. Application Data

(60) Provisional application No. 61/864,862, filed on Aug. 12, 2013.

(51) Int. Cl.
*A47F 7/00* (2006.01)

(52) U.S. Cl.
CPC ..... *A47F 7/0028* (2013.01); *B65H 2701/39* (2013.01)

(58) Field of Classification Search
CPC ..... A47F 7/00; A47F 7/0021; A47F 7/005; A47F 7/0028; B60P 7/0846; B65H 2701/32; B65H 2701/34; B65H 2701/35; B65H 2701/39; B65H 2701/391; B65H 2701/3915; B65H 75/28; B65H 75/146; B65H 2701/319
USPC ..... 211/60.1, 62, 64, 67, 68, 70, 70.2, 70.5, 211/70.8
See application file for complete search history.

(56) References Cited

U.S. PATENT DOCUMENTS 109,602 A * 11/1870 Evans ..... 211/77
228,998 A * 6/1880 Johnston ..... 211/70
660,853 A * 10/1900 Jennings ..... 248/121
712,428 A 10/1902 Whitcomb
929,897 A * 8/1909 Taylor ..... 211/70
1,065,381 A * 6/1913 Martin ..... 211/65
1,259,623 A * 3/1918 Herrick ..... 211/70
1,478,043 A * 12/1923 Matteson ..... 211/68
1,761,088 A * 6/1930 Pryde ..... 211/68
2,376,955 A * 5/1945 Ball ..... 211/60.1
2,872,032 A 2/1959 West
3,777,895 A * 12/1973 Weinstein et al. ..... 211/44
3,826,378 A * 7/1974 Novak ..... 211/70.5
D263,780 S 4/1982 Hildebrand et al.
4,380,296 A * 4/1983 Murray et al. ..... 209/704
4,387,863 A * 6/1983 Edmonston et al. ..... 242/118.4
4,534,473 A * 8/1985 Post ..... 211/58
4,628,628 A * 12/1986 Burgin et al. ..... 43/26
4,688,685 A * 8/1987 Brace ..... 211/70.5
4,753,446 A * 6/1988 Mills ..... 280/47.18
4,819,817 A 4/1989 Mar
4,917,323 A * 4/1990 Wing ..... 242/405.1
5,137,319 A * 8/1992 Sauder ..... 294/159
5,160,101 A * 11/1992 Ferraro et al. ..... 244/118.1
5,265,822 A * 11/1993 Shober et al. ..... 242/388.2

(Continued)

FOREIGN PATENT DOCUMENTS

CH 382612 A * 9/1964

*Primary Examiner* — Stanton L Krycinski
(74) *Attorney, Agent, or Firm* — Gregor N. Neff

(57) ABSTRACT

The storage device has a central elongated support member or shaft and has a plurality of plates extending outwardly from the shaft and secured thereto at spaced intervals along the length of the shaft. Each of the plates has a plurality of hooks and eyes formed around their peripheries. The hooks preferably are shaped to have bungee cords wrapped around them to hold the bungee cords in place, and the eyes are shaped to receive hooks attached to the ends of the bungee cords.

5 Claims, 3 Drawing Sheets

(56) References Cited

U.S. PATENT DOCUMENTS

| | | | | |
|---|---|---|---|---|
| 5,364,042 | A * | 11/1994 | Wyman | 242/348 |
| 5,449,067 | A | 9/1995 | Cannon | |
| 5,669,514 | A * | 9/1997 | Massetti | 211/70.2 |
| 5,678,348 | A * | 10/1997 | Zielinski et al. | 43/26 |
| 5,695,148 | A * | 12/1997 | Christensen | 242/405.3 |
| D394,575 | S | 5/1998 | Mikloczak et al. | |
| 5,845,787 | A | 12/1998 | Dunnavant | |
| 6,099,060 | A | 8/2000 | Towers | |
| 6,497,381 | B2 * | 12/2002 | Rose | 242/402 |
| 6,676,069 | B1 * | 1/2004 | Davis | 242/609.1 |
| 6,886,796 | B1 | 5/2005 | Elander | |
| 6,918,557 | B2 * | 7/2005 | Ast et al. | 242/388.6 |
| D535,512 | S | 1/2007 | Eastman | |
| 7,275,956 | B1 | 10/2007 | Montesano | |
| 7,383,959 | B1 | 6/2008 | Rudd | |
| 7,387,211 | B2 | 6/2008 | Anspach | |
| 7,559,428 | B2 * | 7/2009 | Matzick | 211/64 |
| 7,676,983 | B2 * | 3/2010 | Jenkins | 43/21.2 |
| 8,074,795 | B2 | 12/2011 | Neu et al. | |
| 8,074,814 | B2 * | 12/2011 | Morris et al. | 211/65 |
| 8,287,399 | B2 * | 10/2012 | LaCombe | 473/282 |
| 2007/0039912 | A1 | 2/2007 | Hinkens | |
| 2007/0278166 | A1 * | 12/2007 | Morton | 211/70.8 |
| 2012/0085771 | A1 | 4/2012 | O'Flaherty | |
| 2013/0306781 | A1 * | 11/2013 | Tong | 242/388.1 |

* cited by examiner

CORD STORAGE DEVICE

CROSS-REFERENCE TO RELATED APPLICATIONS

This application claims priority from Provisional Patent Application Ser. No. 61/864,862, filed Aug. 12, 2013. The disclosure of that patent application hereby is incorporated herein by reference.

SEQUENCE LISTING

Not applicable.

STATEMENT REGARDING PRIOR DISCLOSURES BY THE INVENTOR OR A CO-INVENTOR

See above.

BACKGROUND OF THE INVENTION

1. Field of the Invention

This invention relates to a cord storage device, such as an elastic bungee cord storage device, and to such a device which allows the storage of multiple bungee cords in a manner so as to prevent them from becoming tangled with one another.

2. Description of the Related Art Including Information Disclosed Under 37 CFR 1.97 and 1.98

Bungee cords are tough elastic cords, usually with hooks on both ends, which are used to hold covers on cargo in trucks or other cargo carriers, and for similar tasks. They also are used for sporting purposes.

The cords vary widely in length. They are difficult and time-consuming to use when a significant number of them are used or stored in a given location. Often they become tangled with one another when stored together.

Accordingly, a number of different holders have been proposed in the past for neatly storing bungee cords. However, the proposed devices have been less than fully satisfactory. Some have taken up too much space, some have been cumbersome and slow to use, most have been relatively costly to make, and some do not protect the bungee cords from abrasion and other physical damage during storage.

Accordingly, it is an object of the invention to provide a bungee cord storage device which avoids or alleviates the foregoing problems.

It is another object of the invention to provide such a bungee cord storage device which stores the cords compactly and neatly while avoiding tangling of the cords.

It also is an object of the invention to provide such a device which is compact, relatively simple and inexpensive in construction and is easy to use, protects the bungee cords from damage, and is relatively easy to mount in a vehicle.

BRIEF SUMMARY OF THE INVENTION

In accordance with the invention, a storage device is provided in which a central elongated support member or shaft has a plurality of plates extending outwardly from the shaft and secured thereto at spaced intervals along the length of the shaft. Each of the plates has a plurality of hooks and eyes formed around its periphery. The hooks preferably are shaped to have bungee cords wrapped around them to hold the bungee cords in place, and the eyes are shaped to receive hooks attached to the ends of the bungee cords.

The device allows a plurality of bungee cords of varying length to be stored compactly and retrieved quickly. The structure is relatively simple and of modest cost to make.

BRIEF DESCRIPTION OF THE SEVERAL VIEWS OF THE DRAWINGS

The preferred form of the bungee cord storage device of the invention is shown in the attached drawings, in which.

DETAILED DESCRIPTION OF THE INVENTION

Figure 1:
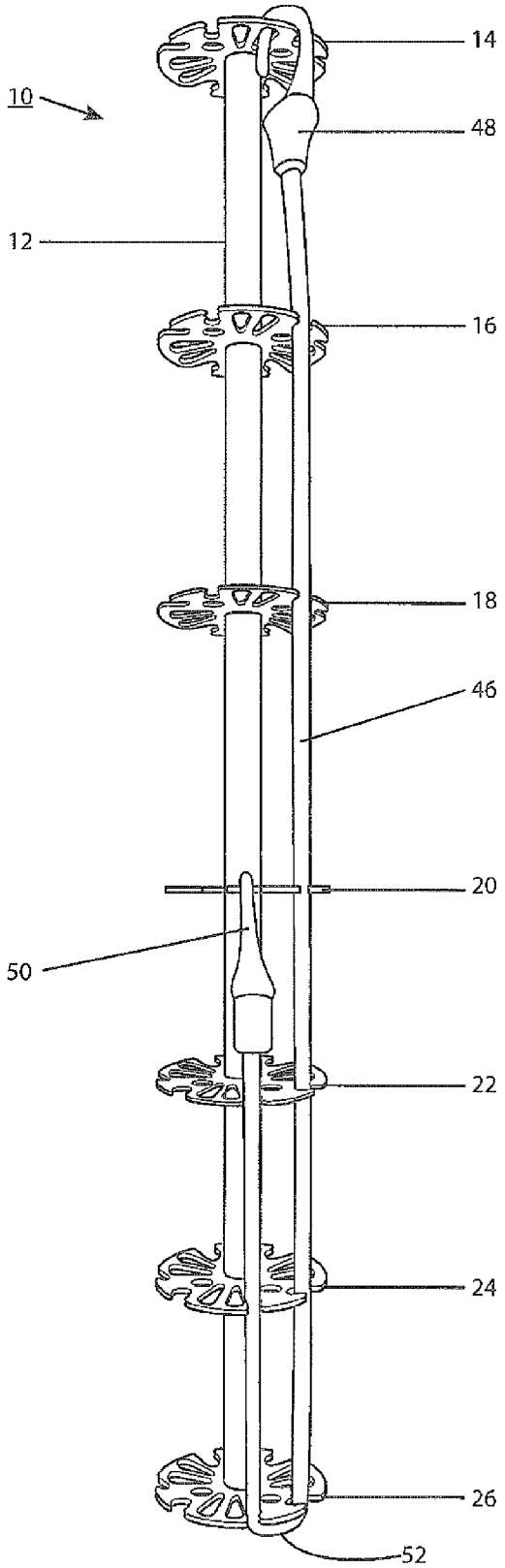
FIG. 1 is a side elevation view of one embodiment of the invention.

Referring to FIG. 1 of the drawings, the storage device 10 has an elongated central support member or shaft 12 and support plates 14, 16, 18, 20, 22, 24, and 26 attached to and extending outwardly from the shaft 12 at spaced intervals along the length of the shaft.

A bungee cord 46 is shown in FIG. 1 secured to the storage device in a manner so as to minimize the chances that it will become tangled with any other bungee cord. The bungee cord has a hook 48 at one end and another hook 50 at the other end, and is wrapped at 52 around a hook on the lower plate 26 of the storage device. The hook 48 is hooked into the top plate 14, and the hook 50 is hooked into another plate 20. The locations of the plates to which the hooks are hooked are determined so as to allow the storage of cords of variable length with each cord stretched taut, at least slightly, without unduly stretching any cord.

Figure 2:
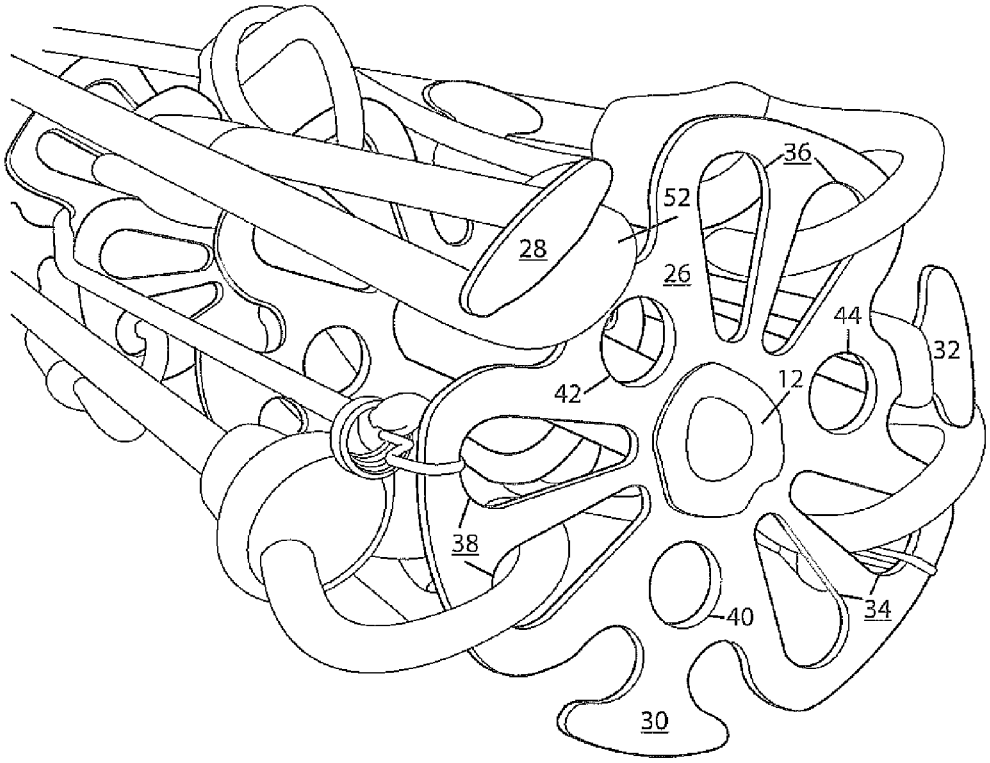
FIG. 2 is an enlarged perspective view of one of the plates of FIG. 1 attached to the central support member of the storage device.

FIG. 2 is a perspective view of the bottom of the circular lower plate 26. The plate 26 has three hooks 28, 30 and 32 extending outwardly from the center of the plate, at radially equidistant positions around the center of the plate. Each of the hooks is approximately T-shaped with circumferentially-extending lobes formed by angled cut-outs on both sides of the hook so as to form receptacles for a bungee cord when it is wrapped around the hook, as indicated at 52.

Also, there are three sets or pairs of eyes 34, 36, and 38 spaced equidistantly from one another radially around the center of the plate 26. Each of the eyes has an elongated radially-extending slot which is larger in diameter at the outer extremities of the disc than towards the center. This shape well suits the hooks which are to be fitted into them.

In use, the hook at one end of a bungee cord is inserted through one of the eyes in one of the end plates 26 or 14 (or in any other desired plate), and the hook at the other end of the bungee cord is inserted into the eye of another plate. The other plate is selected so that the bungee cord is neatly attached to the storage device, and preferably is slightly stretched to make it taut.

If necessary, due to the length of the bungee cord being greater than the length of the storage device, as is the cord 46 shown in FIG. 1, the bungee cord is wrapped around a hook 28, 30 or 32 in one end plate 14 or 26 and attached to another plate, such as the plate 20 as shown in FIG. 1.

The shape of the T-shaped hooks in the plates is well-adapted to receive and hold the bungee cord in place and prevent it from coming loose undesirably, until removed by one intending to do so.

Three extra holes 40, 42 and 44 provide additional receptacles for hooks.

The storage device can be made from a number of different materials. In one embodiment, both the shaft and the plates are all made of metal. In another embodiment, the components of the storage device are made of extruded and molded plastic. Preferably, the shaft 12 is a hollow, plastic tube with or without a metal insert, such as a piece of rebar or metal pipe, if needed, to give extra strength. The plates similarly can be molded plastic or plastic-coated metal or other suitable materials.

The plates can be attached to the shaft by means such as metal welding or ultrasonic welding for plastics, or by adhesives, or by threaded fasteners.

The position of each plate along the length of the shaft can be made adjustable by providing a hub for each of the plates to encircle the shaft, with a single or plurality of set screws which can be loosened to move the plate along the shaft and retightened to hold it in position. Other suitable means can be used to make the position of each plate adjustable.

The shape of the plate as shown in the drawings is circular. However, the plates can be given any shape desired. For example, the plates can be square or rectangular, triangular, or can have a variety of other shapes.

The storage device can be provided with a simple mounting structure for mounting it in a truck or other such vehicle to conveniently store bungee cords in commercial or other vehicles.

Figure 3:
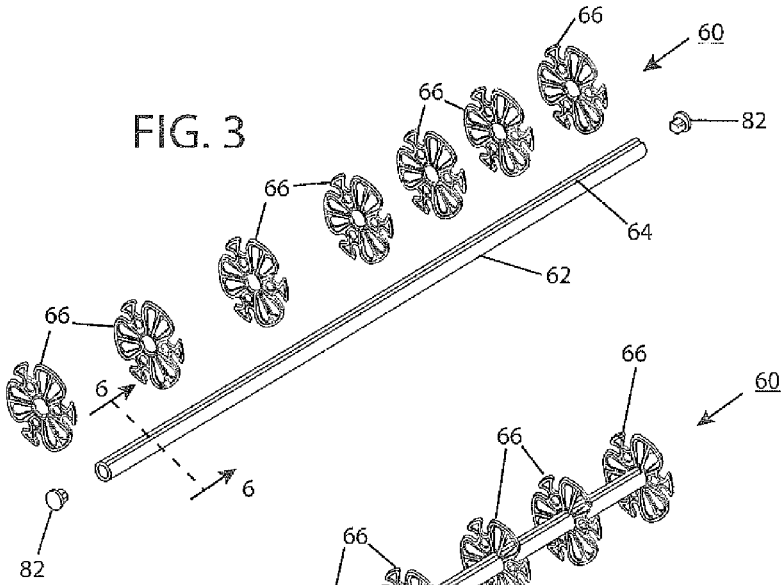
FIG. 3 is an exploded perspective view of another embodiment of the invention.
Figure 4:
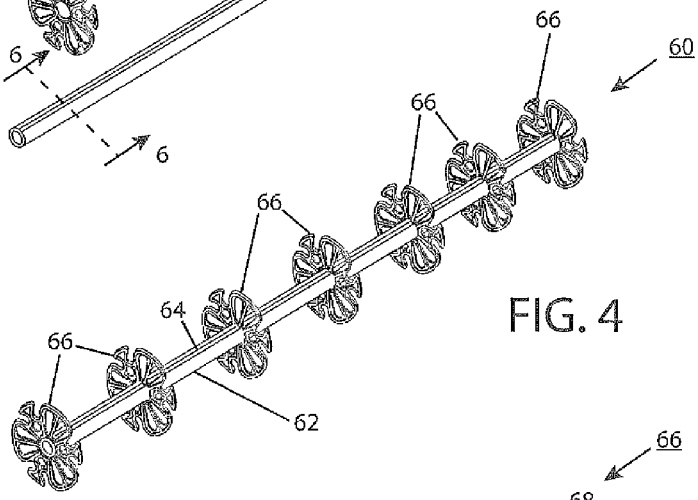
FIG. 4 is an assembled perspective view of the device shown in FIG. 3.

FIGS. 3-6 show another embodiment of the invention. FIG. 4 shows an assembled storage device 60, and FIG. 3 shows the same device in an exploded view.

The device 60 has an extruded plastic tube 62 as a central shaft, with a longitudinal groove 64.

A plurality of plates 66, like the plates 14, 16, etc. shown in FIGS. 1 and 2 are fitted onto the shaft 62 in spaced-apart relationship with one another. Each plate 66 has a short projection 72 (FIG. 5) which fits into the groove 64 to keep the plate 66 from rotating on the shaft. A pair of end caps 82 is fitted over the ends of the shaft to close its hollow interior.

Figure 6:
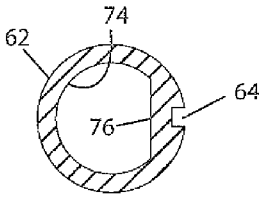
FIG. 6 is a cross-sectional view taken along line 6-6 of FIG. 3.

Referring to FIG. 6, the shaft 62 is an extruded hollow tube made of stiff, tough thermoplastic such as ABS.

Figure 5:
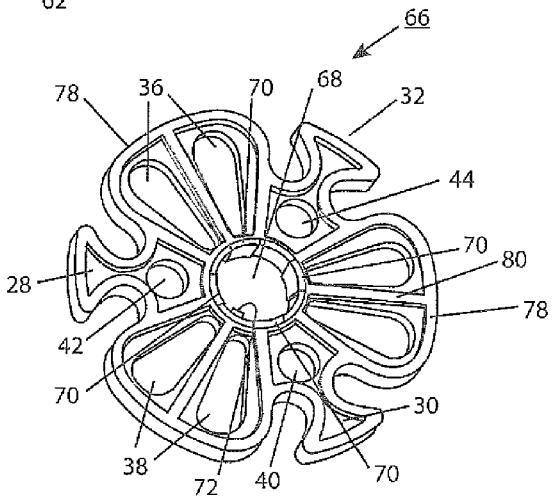
FIG. 5 is an enlarged perspective view of one of the components of the device of FIGS. 3 and 4.

As shown in FIG. 5, each plate 66 has the same hooks and eyes as the plate shown in FIG. 2. However, the plate 66 is molded out of a tough plastic such as ABS, and has reinforcing ribs such as 80.

Also, the plate 66 has a central hole 68 to fit around the shaft 62, with four friction pads 70 to bear against the outside surface of the shaft when the shaft is inserted into the hole 68.

The device 60 is assembled by sliding the plates onto the shaft 62 with the projection 72 of each plate fitted into the groove 64, and then seeming each plate at a desired location along the shaft by adhesive or ultrasonic welding or the like.

FIG. 6 shows the cross-sectional shape of the shaft to be a circular tube with an internal thickened area 76 to keep the groove 64 from compromising the strength of the tube.

The above description of the invention is intended to be illustrative and not limiting. Various changes or modifications in the embodiments described may occur to those skilled in the art. These can be made without departing from the spirit or scope of the invention.

The invention claimed is:

1. A bungee cord and storage device comprising a. an elongated central support member, and b. a plurality of spaced-apart plates secured along the length of said elongated support member and extending outwardly therefrom, c. each of said plates having a plurality of support hooks and eyes spaced around the periphery of said plate, in which each of said eyes is dimensioned to receive and hold at least one bungee cord hook and each of said support hooks is open and dimensioned to receive and hold at least one bungee cord therein whereby said bungee cord can be wrapped around and held in place by said support hook, and d. at least one elastic bungee cord with two ends, said cord being releasably attached adjacent one of said ends to one of said support hooks and eyes in a first one of said plates, and extending lengthwise in the direction of said elongated central support member and attached to at least one other of said plates to hold said cord in an extended position on said storage device.

2. A bungee cord and storage device as in claim 1 in which said support hooks are generally T-shaped with laterally-extending, outwardly-positioned extensions providing crevices into which said bungee cord can fit and will be held in place, said bungee cord being wrapped around one of said support hooks at a location on said cord intermediate said ends of said cord.

3. A bungee cord and storage device as in claim 1 in which at least a plurality of said plates is circular in shape, each of said support hooks being formed by a pair of incursions in the outside edge of said circular plate to form a radially-extending lobe, at least one of said eyes being formed in said lobe.

4. A bungee cord and storage device as in claim 1 in which said cord has a bungee hook at each of said ends, one of said bungee hooks being hooked into said first plate and the other of said bungee hooks being hooked into a second one of said plates spaced from said first plate.

5. A bungee cord and storage device as in claim 1 including a hole in said plate located inwardly from each of said support hooks, said hole being sized to receive a bungee cord hook.

* * * * *